United States Patent [19]

Vernay

[11] 4,267,934

[45] May 19, 1981

[54] TELESCOPICALLY EXTENDIBLE MAST CRANE

[75] Inventor: Henri Vernay, La Clayette, France

[73] Assignee: S.A. A C M A G, Semur en Brionnais, France

[21] Appl. No.: 926,567

[22] Filed: Jul. 20, 1978

[30] Foreign Application Priority Data

Jul. 22, 1977 [FR] France ..... 77 23362

[51] Int. Cl.[3] ..... B66C 23/42

[52] U.S. Cl. ..... 212/184; 212/188

[58] Field of Search ..... 212/46 R, 46 A, 46 B, 212/56, 57, 58 R, 58 A, 59 R, 61, 62, 63, 64, 65, 182–188, 227, 232, 254

[56] References Cited

FOREIGN PATENT DOCUMENTS

| | | | |
|---|---|---|---|
| 265507 | 12/1963 | Australia | 212/46 R |
| 1531159 | 12/1969 | Fed. Rep. of Germany | 212/59 |
| 2134083 | 5/1972 | Fed. Rep. of Germany . | |
| 2239411 | 2/1975 | France | 212/46 B |
| 2370675 | 6/1978 | France | 212/59 R |
| 6800705 | 7/1968 | Netherlands | 212/46 B |

*Primary Examiner*—Stephen G. Kunin
*Assistant Examiner*—Edmond G. Rishell, Jr.
*Attorney, Agent, or Firm*—Fleit & Jacobson

[57] ABSTRACT

A device for folding and unfolding a hinged boom pivotally mounted atop a telescopic crane mast, in which a cable is secured to the mast and passes over pulleys located, in sequence, at the top of the lower mast section, the bottom of the upper mast section, the top of the upper mast section and on the first boom section adjacent the hinge and thence to another anchor point adjacent the free end of the second boom section. Preferably a spacer strut is placed at the hinge and as the mast telescopes downwardly torque in the cable causes the second boom section to pivot, at the hinge, so that when telescoping is complete the mast and both boom sections are in a coplanar parallel relationship.

4 Claims, 5 Drawing Figures

TELESCOPICALLYEXTENDIBLE MAST CRANE

BACKGROUND OF THE INVENTION

This invention deals with improvements to telescopic cranes, and in particular, to mechanisms which allow complete automatic folding and unfolding of an articulated boom during the respective contraction and extension of the mast components.

Several devices such as these exist, but none allow complete folding of the head of the boom on its base as the units of the telescopic mast contract. In most cases the tip of the boom touches the ground, making it necessary to design a roller so that it can move about. In keeping with other known solutions, the end of the boom does not touch the ground but it does not fold up against the base of the boom without manual intervention.

SUMMARY OF THE INVENTION

An object of this invention is to provide a system that ensures complete folding and unfolding of a boom during the respective contraction or extension of the telescopic units of the mast.

Thus, by one aspect of this invention there is provided a device for complete folding or unfolding of a hinged two section boom pivotally mounted at one end of a first section thereof atop a telescopically extendible crane mast comprising:

(a) first pulley means rotatably mounted adjacent the upper end of a lower section of said crane mast;

(b) second and third pulley means rotatably mounted adjacent the lower and upper ends respectively of an upper section of said crane mast;

(c) fourth pulley means rotatably mounted on said first boom section adjacent the hinge; and (d) a substantially inextensible cable of selected length secured at one end thereof to said crane mast reeved over said first, second, third and fourth pulley means and secured at the other end thereof adjacent the free end of the second section of said boom, so that upon relative movement of said upper and lower sections of said crane mast, said second section of said boom pivots relative to said first section thereof.

BRIEF DESCRIPTION OF THE DRAWINGS

The accompanying drawings, given as an example, make it easier to understand the invention, its features, and the possible advantages which may be gained by its use.

DESCRIPTION OF PREFERRED EMBODIMENT

Figure 1:
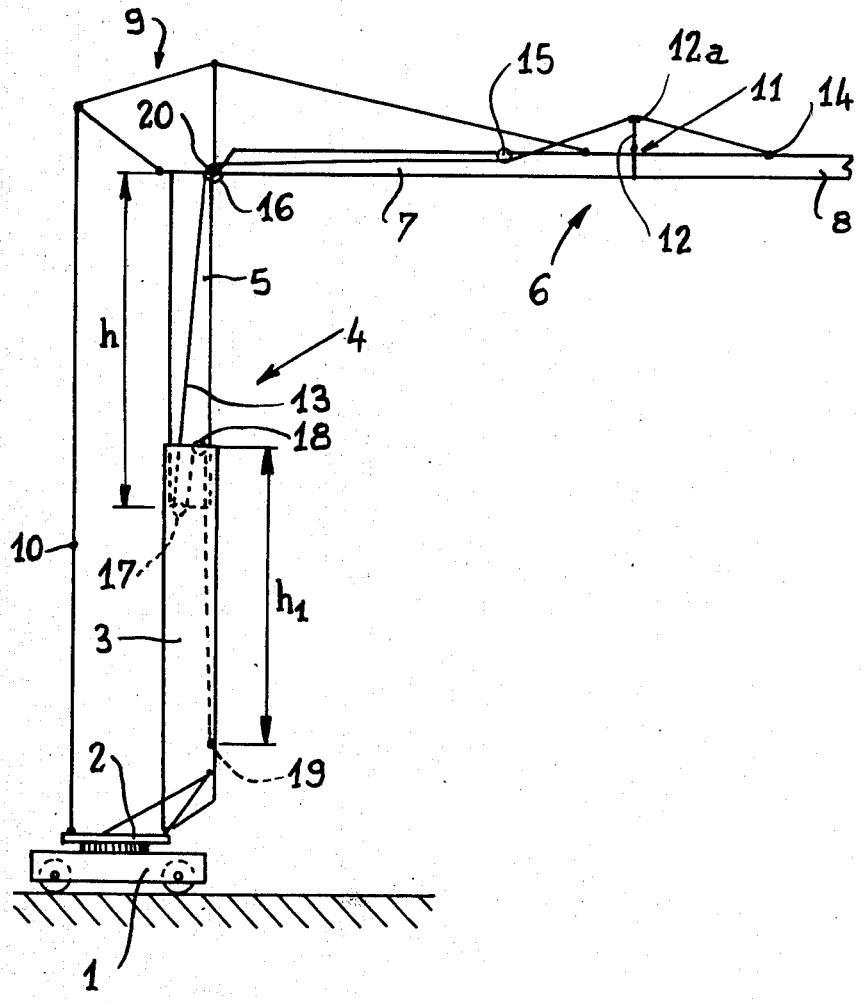
FIG. 1 is a front elevation of a telescopic crane with an articulated boom in operating position, equipped with a mechanism according to the invention.
Figure 2:
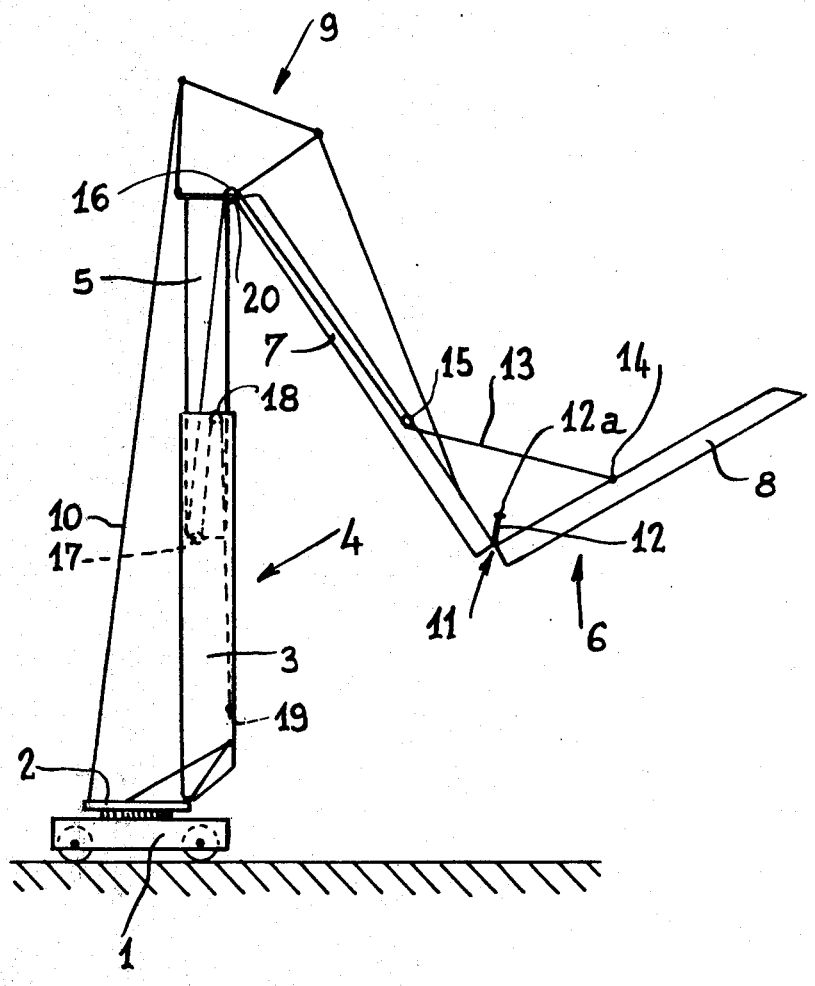
FIG. 2 shows how the boom folds up according to the invention as its telescopic mast contracts.

FIG. 1 represents a regular telescopic crane with a folding boom. First, this type of crane has a carriage 1 connected to a platform 2 which supports the lower unit 3 of a telescopic mast 4, the upper unit 5 of which is articulated to a boom 6 which has a main section 7 and an extension 8.

As is well known in the art, the crane is equipped with a boom stop 9 connected to the platform 2 by a stay 10 which is of fixed length. Thus after the mast 4 is extended, the main boom 7 becomes horizontal. This telescopic movement of upper unit 5 of the mast 4, in relation to lower unit 3 is carried out by other means not described here.

It will be noted that the extension 8 of the boom 6 is articulated to the main boom 7 by a hinge 11 located on the upper edge of the main boom 7. The boom extension 8 may then pivot around the hinge 11 so that its upper edge touches that of the main boom 7. Note that the boom extension 8 is provided with a strut 12 above hinge 11. The purpose of this strut will be explained more clearly further on.

Figure 5:
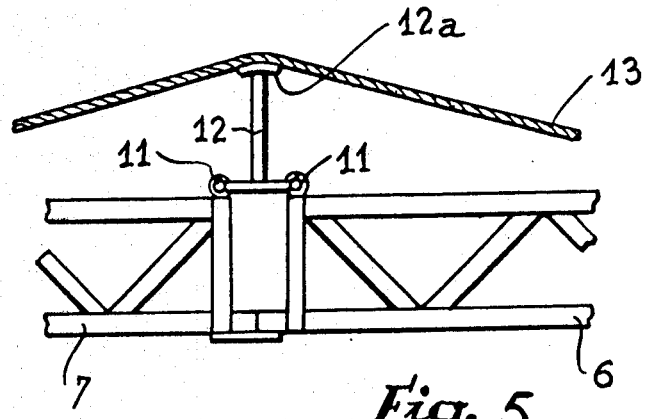
FIG. 5 is an enlarged view of a part of the boom showing how the cable cooperates with a slipper.

A fixed length inextensible cable 13 joins the two units of the mast, as well as the base and the end of the boom. One end of cable 13 is fastened at 14 to the upper edge of the boom extension 8; it then runs over a slipper 12*a*, as shown in FIG. 5 located at the free end of the strut 12, then under a pulley 15, rotatably mounted on the main boom 7. This cable then winds around a pulley 16, whose axis of rotation is integral with the upper part of unit 5 of the mast, and around pulleys 17 and 18, which are rotatably mounted on fixed axes at the base of unit 5 and at the head of unit 3 respectively, to an attachment point 19 on lower unit 3.

Note that there is an equal fixed distance h between pulleys 16 and 17, and $h_1$ between pulley 18 and attachment point 19. When unit 5 lowers into unit 3, increasing the distance between pulleys 17 and 18, traction occurs by means of cable 13 which is attached to the boom extension 8. Due to the presence of strut 12, this traction produces a torque which causes the boom extension to pivot around hinge 11, the cable leaving the slipper 12*a* of the strut 12 after the boom extension has moved a certain distance.

The main boom 7 gradually folds back, pivoting around its hinge axis 20 to rest vertically against unit 3 of the mast 4. In this position, it will be noted that unit 5 of the mast goes a certain distance d past unit 3. Distance d1 between attachment point 14 of cable 13 on the boom extension 8 in relation to pulley 15 must therefore be at all times equal to distance d. This being so, when $d=0$, i.e. when unit 5 is completely retracted in unit 3, attachment point 14 is right beside pulley 15 and the boom extension 8 is then vertically parallel to the main boom 7.

Figure 4:
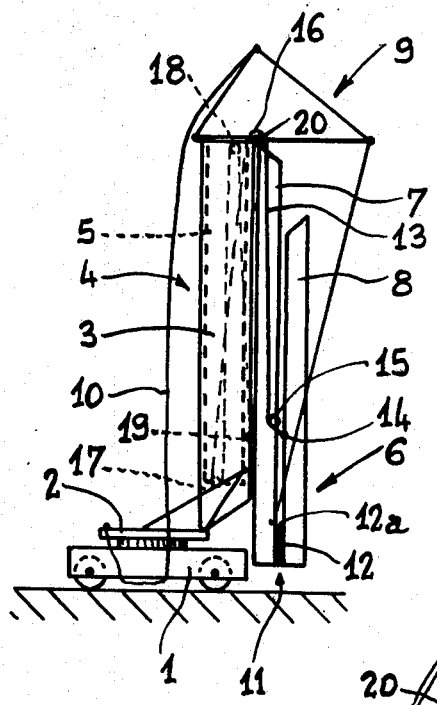
FIG. 4 shows the crane with its boom entirely folded after the mast has completely contracted.
Figure 3:
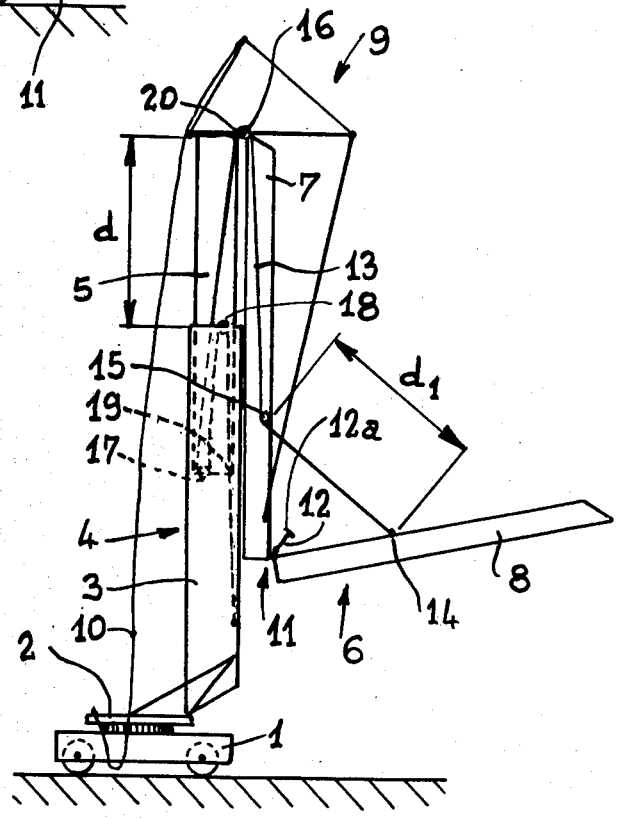
FIG. 3 is a view similar to FIG. 2 showing further folding of the boom.

Naturally, when the crane is set in its operating position and the mast extended, the process is reversed and the sequence of operation is from FIG. 4 to FIG. 1.

Thus there is created a simple, and therefore economic, system for folding and unfolding a two-piece boom of a telescopic crane, which will further save time in mounting and dismantling since all the operations are carried out without contact between the boom extension and the ground, and without any manual interference.

It goes without saying that in terms of the desired height of the mast, attachment 19 of cable 13 may be fitted anywhere on the lower unit 3 of the mast. Furthermore, each pulley (17,18) may be replaced with a block to completely fold or unfold the boom when the mast is slightly extended.

However, it must be understood that the preceding description has been given only as an example, and that it by no means limits the field of invention.

I claim:

1. A device for complete folding or unfolding of a hinged two section boom pivotally mounted at one end of a first section thereof atop a telescopically extendible crane mast comprising:

(a) first pulley means rotatably mounted adjacent the upper end of a lower section of said crane mast;

(b) second and third pulley means rotatably mounted adjacent the lower and upper ends respectively of an upper section of said crane mast;

(c) fourth pulley means rotatably mounted on said first boom section adjacent the hinge;

(d) a substantially inextensible cable of selected length secured at one end thereof to said crane mast and reeved over said first, second, third and fourth pulley means, said cable being secured at the other end thereof adjacent the free end of the second section of said boom, so that upon relative movement of said upper and lower sections of said crane mast, said second section of said boom pivots relative to said first section thereof;

(e) said first and third pulley means in all positions of said boom having a distance therebetween equal to the distance between said fourth pulley means and said other end of said cable; and (f) wherein said mast and said first and second boom sections are in substantially coplanar parallel relationship when said mast sections are in a fully retracted position.

2. A device as claimed in claim 1 including strut means on said hinge to receive said cable when said mast is in an extended position.

3. A device as claimed in claim 2 wherein said strut means includes slipper means to slidably and releasably engage said cable.

4. A device as claimed in claim 1, 2 or 3 wherein said one end of said cable is secured to said lower section of said mast.

* * * * *